US010595682B2

(12) United States Patent
Racanelli

(10) Patent No.: US 10,595,682 B2
(45) Date of Patent: Mar. 24, 2020

(54) BATHING CHAIR ASSEMBLY

(71) Applicant: Maria Racanelli, Dobbs Ferry, NY (US)

(72) Inventor: Maria Racanelli, Dobbs Ferry, NY (US)

( * ) Notice: Subject to any disclaimer, the term of this patent is extended or adjusted under 35 U.S.C. 154(b) by 0 days.

(21) Appl. No.: 16/032,477

(22) Filed: Jul. 11, 2018

(65) Prior Publication Data

US 2020/0015635 A1 Jan. 16, 2020

(51) Int. Cl.

| | |
|---|---|
| ***A47K 3/12*** | (2006.01) |
| ***A61G 5/10*** | (2006.01) |
| ***A47K 3/28*** | (2006.01) |
| ***A47C 7/02*** | (2006.01) |

(52) U.S. Cl.

CPC ..... *A47K 3/122* (2013.01); *A47C 7/02* (2013.01); *A47K 3/282* (2013.01); *A61G 5/10* (2013.01)

(58) Field of Classification Search

CPC ..... A47K 3/122
USPC ..... 4/578.1
See application file for complete search history.

(56) References Cited

U.S. PATENT DOCUMENTS

| | | | | |
|---|---|---|---|---|
| 3,040,335 | A * | 6/1962 | Gellmann | A47K 3/122 4/570 |
| 4,253,203 | A | 3/1981 | Thomas | |
| 5,682,626 | A * | 11/1997 | Banks, Jr. | A47K 3/122 4/541.5 |
| 6,039,403 | A | 3/2000 | Hargroder | |
| 6,256,806 | B1 | 7/2001 | DiTommaso | |
| 6,842,919 | B2 * | 1/2005 | Wilson | A47K 3/282 297/180.15 |
| D611,715 | S | 10/2010 | Werschmidt | |
| 9,095,483 | B2 * | 8/2015 | Storm | A61G 5/1002 |
| 9,307,868 | B2 | 4/2016 | Lin | |

* cited by examiner

*Primary Examiner* — Lori L Baker

(57) ABSTRACT

A bathing chair assembly that allows access to genital and perianal regions of a bather includes a seat. A plurality of legs is coupled to and extends substantially perpendicularly from a bottom of the seat. The legs are configured to support the seat substantially parallel to a substantially horizontal surface, positioning the seat to support the bather. A backrest that is coupled to and extends from a rear edge of the seat is configured to support a back of the bather who is positioned on the seat. A void that is centrally positioned in the seat is configured to allow a user access to the genital and perianal regions of the bather.

19 Claims, 6 Drawing Sheets

94
98
56
10
96
76
86
88
92
12
90
84
54
24
44
70
72

BATHING CHAIR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to chair assemblies and more particularly pertains to a new chair assembly that allows access to genital and perianal regions of a bather.

BRIEF SUMMARY OF THE INVENTION

An embodiment of the disclosure meets the needs presented above by generally comprising a seat. A plurality of legs is coupled to and extends substantially perpendicularly from a bottom of the seat. The legs are configured to support the seat substantially parallel to a substantially horizontal surface, positioning the seat to support a bather. A backrest that is coupled to and extends from a rear edge of the seat is configured to support a back of the bather who is positioned on the seat. A void that is centrally positioned in the seat is configured to allow a user access to genital and perianal regions of the bather.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
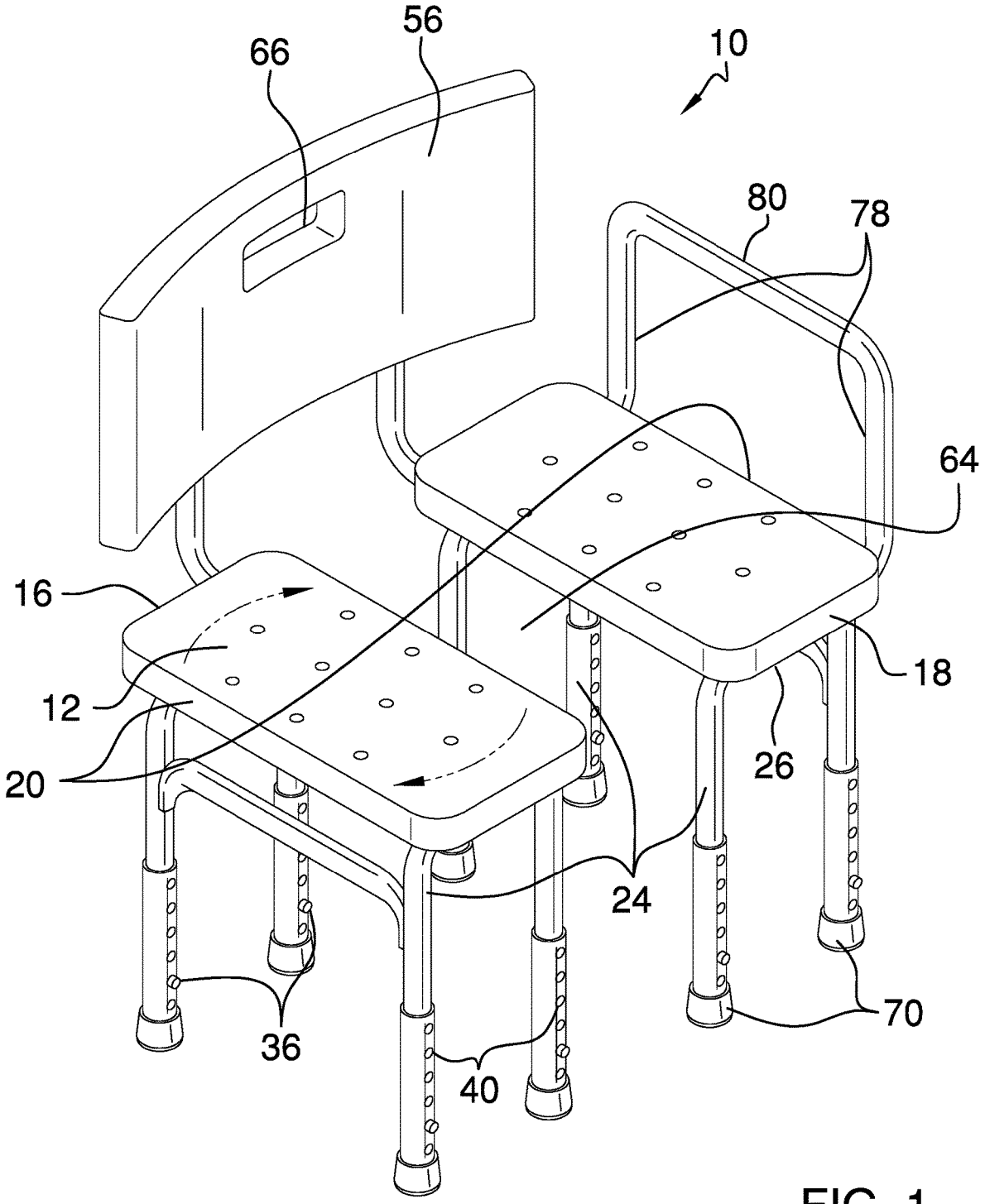
FIG. 1 is an isometric perspective view of a bathing chair assembly according to an embodiment of the disclosure.

With reference now to the drawings, and in particular to FIGS. 1 through 6 thereof, a new chair assembly embodying the principles and concepts of an embodiment of the disclosure and generally designated by the reference numeral 10 will be described.

As best illustrated in FIGS. 1 through 6, the bathing chair assembly 10 generally comprises a seat 12 that is substantially rectangularly shaped. The seat 12 comprises a pair of plates 14. Each plate 14 extends from a rear edge 16 to a front edge 18 along a respective opposing side edge 20 of the seat 12. The plates 14 define a gap 22 that is positioned substantially equally distant from the opposing side edges 20 of the seat 12.

Figure 5:
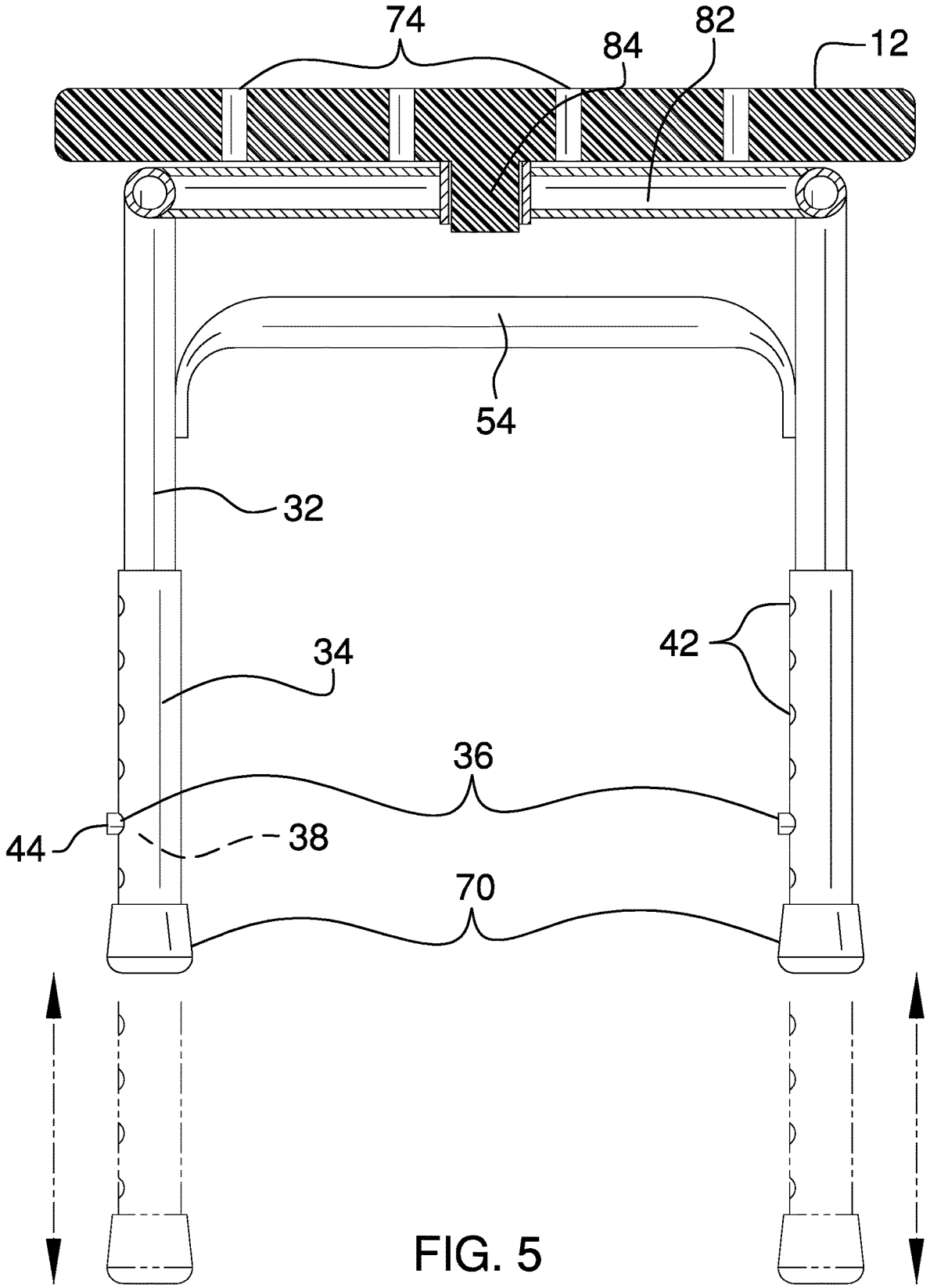
FIG. 5 is a cross-sectional view of an embodiment of the disclosure.
Figure 6:
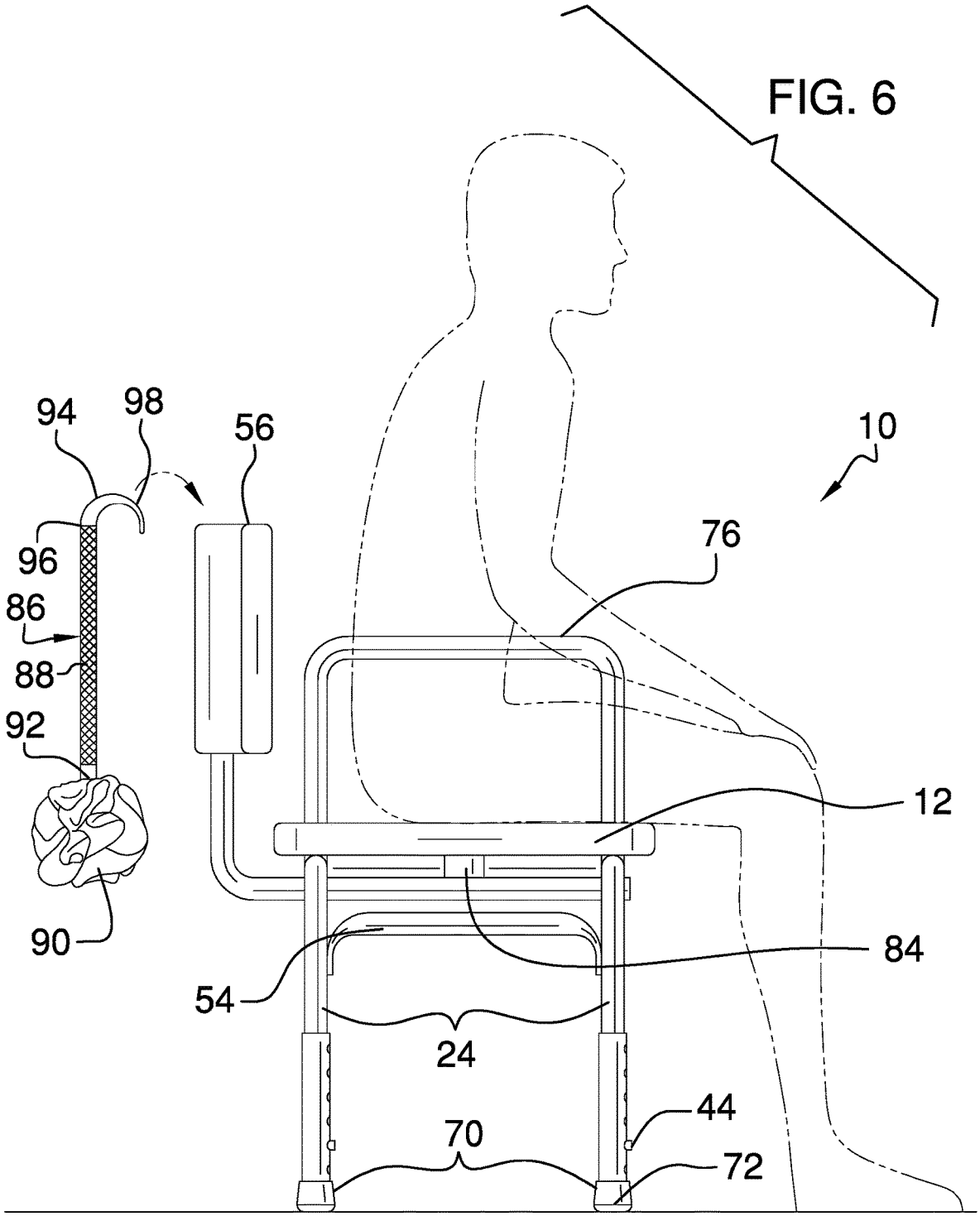
FIG. 6 is an in-use view of an embodiment of the disclosure.

Each of a plurality of legs 24 is coupled to and extends substantially perpendicularly from a bottom 26 of the seat 12. The legs 24 are configured to support the seat 12 substantially parallel to a substantially horizontal surface, positioning the seat 12 to support a bather, as shown in FIG. 6. The legs 24 are circularly shaped when viewed longitudinally. Each leg 24 comprises a plurality of nested sections 28 so that the leg 24 is selectively extensible, as shown in FIG. 5. The plurality of legs 24 comprises eight legs 24 that are positioned singly at each corner 30 of each of the pair of plates 14. The plurality of nested sections 28 comprises an upper section 32 that is selectively extensible from a lower section 34.

Each of a plurality of first couplers 36 is coupled to the upper section 32 of a respective leg 24 proximate to a lower terminus 38 of the upper section 32. Each of a plurality of second couplers 40 is coupled to the lower section 34 of a respective leg 24. The second couplers 40 are complementary to the first couplers 36. Each second coupler 40 is positioned to selectively couple to an associated first coupler 36 to couple the lower section 34 to the upper section 32 to fixedly position the lower section 34 relative to the upper section 32.

Each second coupler 40 comprises a plurality of leg holes 42. Each first coupler 36 comprises a pin 44. The pin 44 is spring-loaded. The pin 44 is configured to be depressed to selectively extend the upper section 32 relative to the lower section 34, positioning the pin 44 to insert into a respective leg hole 42 to fixedly position the upper section 32 relative to the lower section 34.

Figure 4:
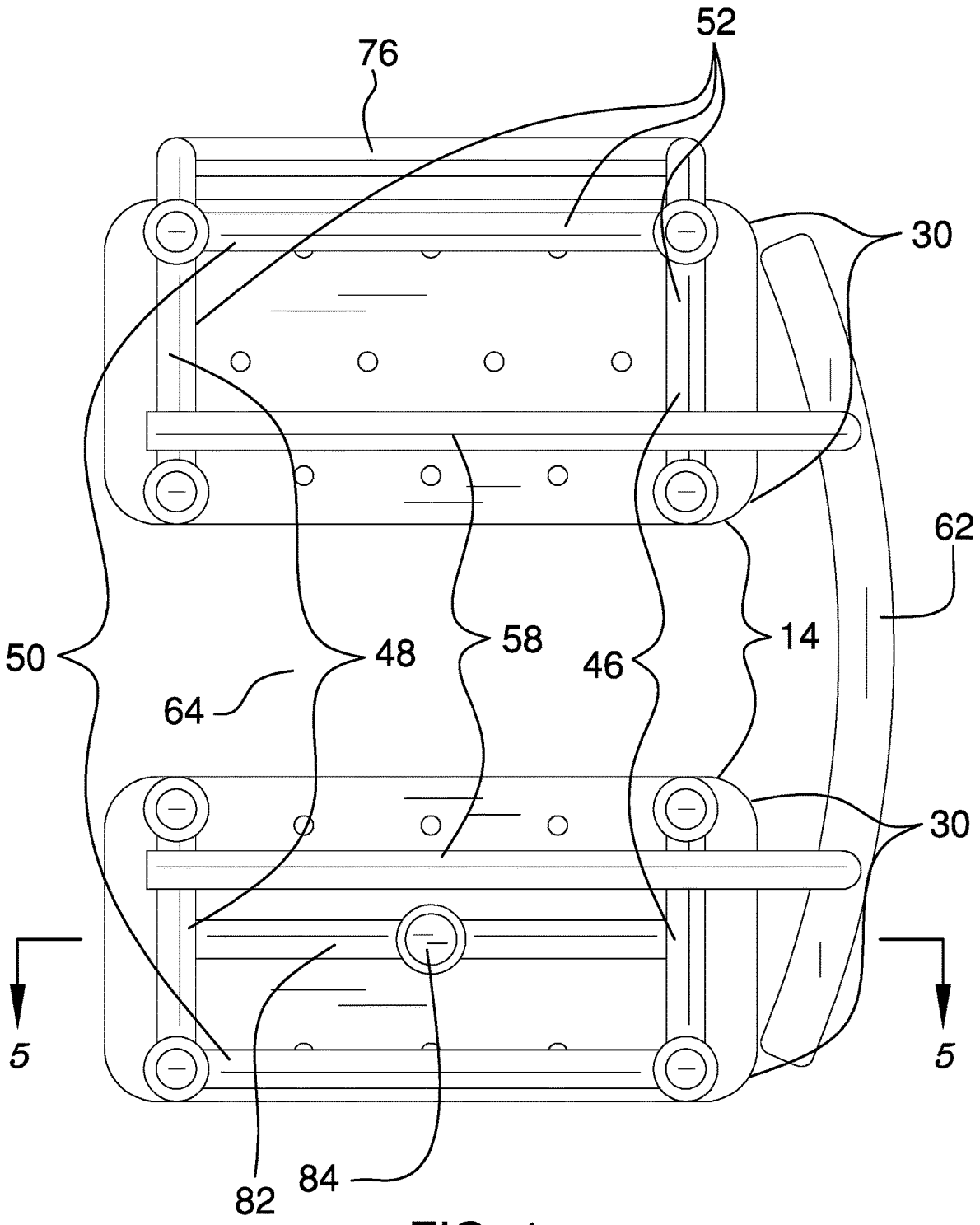
FIG. 4 is a bottom view of an embodiment of the disclosure.

Each of a pair of rear crossbars 46 is coupled to and extends between the legs 24 positioned on an associated plate 14 proximate to the rear edge 16 of the seat 12, as shown in FIG. 4. Each of a pair of front crossbars 48 is coupled to and extends between the legs 24 positioned on an associated plate 14 proximate to the front edge 18 of the seat 12, as shown in FIG. 4. One front crossbar 48 and an associated rear crossbar 46 extend past an associated opposing side edge 20 of the seat 12, as shown in FIG. 4.

Each of a pair of side crossbars 50 is coupled to and extends between the legs 24 positioned on an associated plate 14 proximate to the respective opposing side edge 20 of the seat, as shown in FIG. 4. Each side crossbar 50, an associated rear crossbar 46, and an associated front crossbar 48 define a frame 52 to which an associated plate 14 is coupled.

Each of a pair of crossbeams 54 is coupled to and extends between the legs 24 positioned proximate to a respective opposing side edge 20 of the seat 12, as shown in FIG. 1. The crossbeam 54 is positioned proximate to the seat 12 to stabilize the legs 24 relative to the seat 12.

Figure 2:
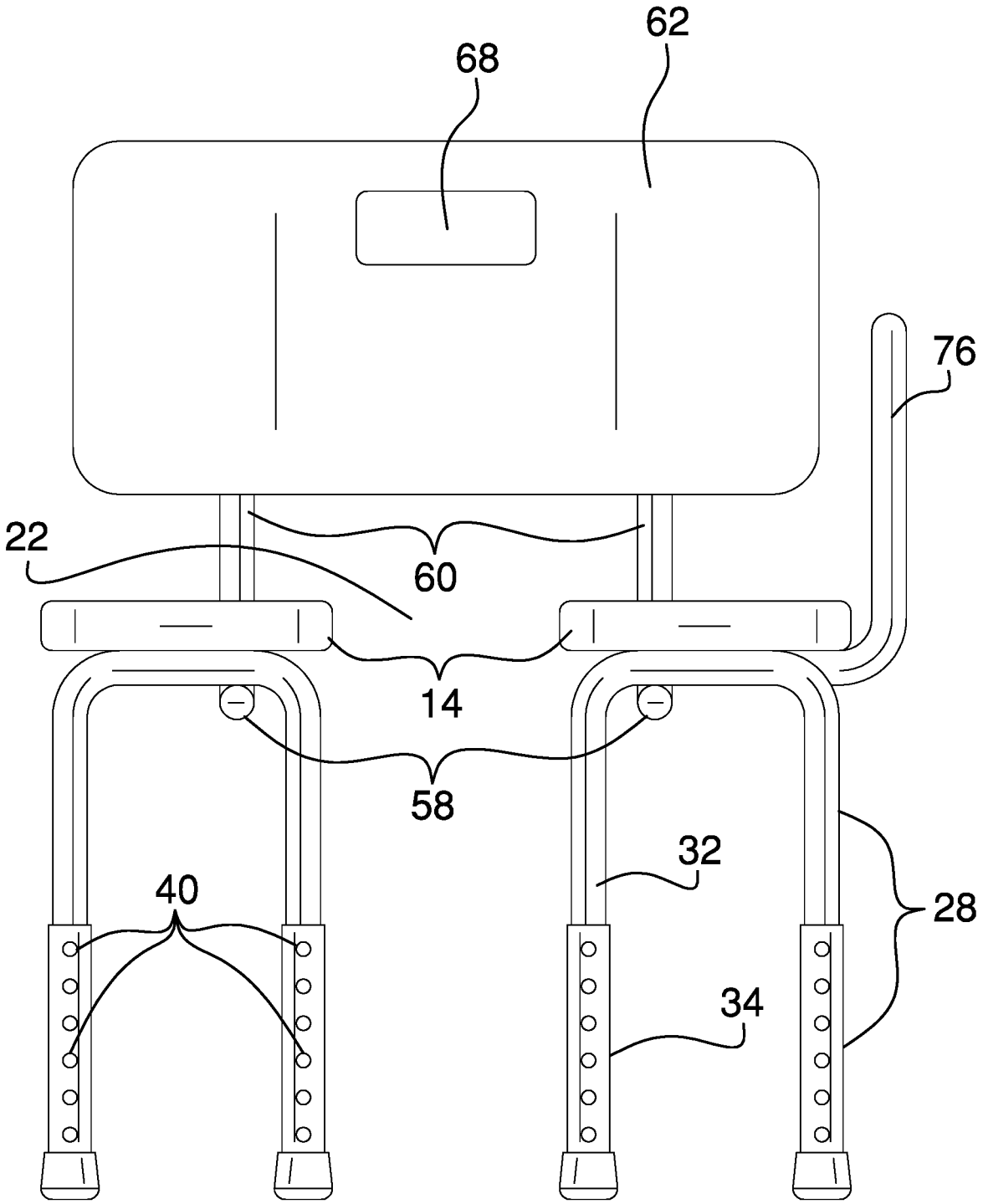
FIG. 2 is a front view of an embodiment of the disclosure.

A backrest 56 is coupled to and extends from the rear edge 16 of the seat 12, as shown in FIG. 2. The backrest 56 is configured to support a back of the bather who is positioned on the seat 12. The backrest 56 is concavely arcuate. The backrest 56 is configured to complement a profile of the back of the bather.

The backrest 56 comprises a pair of support rods 58. Each support rod 58 is coupled to and extends from the frame 52 so that the support rod 58 protrudes from the rear edge 16 of the seat 12. Each of a pair of vertical rods 60 is coupled to and extends substantially perpendicularly from a respective support rod 58 distal from the seat 12. A panel 62 is coupled to the vertical rods 60 distal from the support rods 58. The panel 62 extends arcuately between the vertical rods 60.

A void 64 is centrally positioned in the seat 12, as shown in FIG. 2. The void 64 is configured to allow a user access to genital and perianal regions of a bather who is positioned on the seat 12. The void 64 comprises the gap 22 that is defined by the first plate 14 and the second plate 14.

A handle 66 is coupled to the backrest 56. The handle 66 is configured to be grasped in a hand of a user. The handle 66 comprises an orifice 68 that is positioned through the panel 62. The orifice 68 is rectangularly shaped.

Each of a plurality of feet 70 is coupled to a lower end 72 of a respective leg 24. The feet 70 are configured to grip a surface upon which the legs 24 are positioned. The feet 70 comprise rubber or the like.

Figure 3:
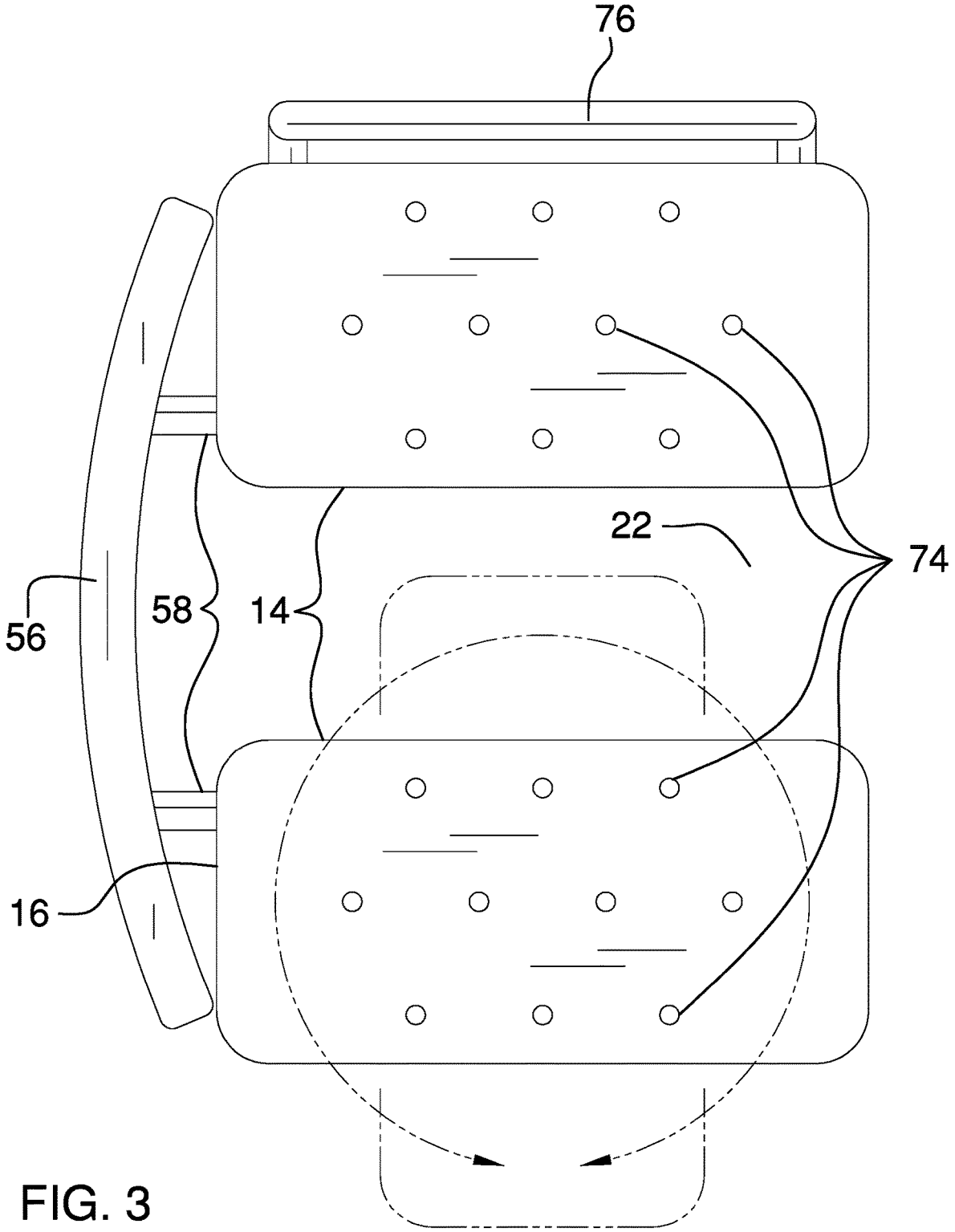
FIG. 3 is a top view of an embodiment of the disclosure.

A plurality of drain holes 74 is positioned through the seat 12, as shown in FIG. 3. The drain holes 74 are configured to allow water to drain through the seat 12.

An armrest 76 is coupled to and extends from a respective opposing side edge 20 of the seat 12, as shown in FIG. 2. The armrest 76 is configured to support an arm of the bather, as well as to assist the bather in lowering to and rising from the seat 12.

The armrest 76 comprises a pair of first rods 78 and a second rod 80. The first rods 78 are coupled singly to and extends perpendicularly from the one front crossbar 48 and the associated rear crossbar 46 that extend past the associated opposing side edge 20 of the seat 12. The second rod 80 is coupled to and extends between the first rods 78 distal from the respective plate 14.

A center crossbar 82 is coupled to and extends between the other front crossbar 48 and an associated rear crossbar 46, as shown in FIG. 4. A pivot 84 is coupled to the center crossbar 82 substantially equally distant from the other front crossbar 48 and the associated rear crossbar 46, as shown in FIG. 5. An associated plate 14 is coupled to the pivot 84 and is positioned to rotate relative to an associated frame 52. The associated plate 14 being rotatable relative to the frame 52 allows the bather to be selectively positioned relative to the associated frame 52.

The assembly 10 also comprises a tool 86, as shown in FIG. 6. The tool 86 comprises a shaft 88 and a head 90. The head 90 is coupled to a first end 92 of the shaft 88. The head 90 comprises sponge. The shaft 88 is configured to be grasped in the hand of the user, positioning the user to manipulate the head 90 to clean the genital and perianal regions of the bather who is positioned on the seat 12.

A connector 94 is coupled to a second end 96 of the shaft 88. The connector 94 is configured to removably couple to the backrest 56 to couple the tool 86 to the backrest 56. The connector 94 comprises a hook 98 that extends from the second end 96 of the shaft 88.

In use, the assembly 10 is positioned in a shower or bathtub. The bather is then positioned on the seat 12. The gap 22 defined by the pair of plates 14 allow the user to use the tool 86 to clean the genital and perianal regions of the bather.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bathing chair assembly comprising:

a seat;

a plurality of legs coupled to and extending substantially perpendicularly from a bottom of the seat wherein the legs are configured for supporting the seat substantially parallel to a substantially horizontal surface positioning the seat for supporting a bather;

a backrest coupled to and extending from a rear edge of the seat wherein the backrest is configured for supporting a back of the bather positioned on the seat;

a void centrally positioned in the seat wherein the void is configured for allowing a user access to genital and perianal regions of a bather positioned on the seat; and a tool comprising a shaft and a head, the head being coupled to a first end of the shaft, the head comprising sponge wherein the shaft is configured for grasping in the hand of the user positioning the user for manipulating the head for cleaning the genital and perianal regions of the bather positioned on the seat.

2. The assembly of claim 1, further including the seat being substantially rectangularly shaped, the seat comprising a pair of plates, each plate extending from the rear edge to a front edge along a respective opposing side edge of the seat, the plates defining a gap positioned substantially equally distant from the opposing side edges of the seat, the void comprising the gap defined by the first plate and the second plate.

3. The assembly of claim 2, further including the legs being circularly shaped when viewed longitudinally, each leg comprising a plurality of nested sections such that the leg is selectively extensible.

4. The assembly of claim 3, further including the plurality of nested sections comprising an upper section selectively extensible from a lower section.

5. The assembly of claim 2, further including the plurality of legs comprising eight legs positioned singly at each corner of each of the pair of plates.

6. A bathing chair assembly comprising:

a seat, the seat being substantially rectangularly shaped, the seat comprising a pair of plates, each plate extending from the rear edge to a front edge along a respective opposing side edge of the seat, the plates defining a gap positioned substantially equally distant from the opposing side edges of the seat, the void comprising the gap defined by the first plate and the second plate;

a plurality of legs coupled to and extending substantially perpendicularly from a bottom of the seat wherein the legs are configured for supporting the seat substantially parallel to a substantially horizontal surface positioning the seat for supporting a bather, each of the legs being circularly shaped when viewed longitudinally, each leg comprising a plurality of nested sections such that the leg is selectively extensible, the plurality of nested sections comprising an upper section selectively extensible from a lower section;

a backrest coupled to and extending from a rear edge of the seat wherein the backrest is configured for supporting a back of the bather positioned on the seat;

a void centrally positioned in the seat wherein the void is configured for allowing a user access to genital and perianal regions of a bather positioned on the seat;

a plurality of first couplers, each first coupler being coupled to the upper section of a respective leg proximate to a lower terminus of the upper section; and a plurality of second couplers, each second coupler being coupled to the lower section of a respective leg, the second couplers being complementary to the first couplers wherein each second coupler is positioned for selectively coupling to an associated first coupler for coupling the lower section to the upper section for fixedly positioning the lower section relative to the upper section.

7. The assembly of claim 6, further including each second coupler comprising a plurality of leg holes, each first coupler comprising a pin, the pin being spring-loaded wherein the pin is configured for depressing for selectively extending the upper section relative to the lower section positioning the pin for inserting into a respective leg hole for fixedly positioning the upper section relative to the lower section.

8. The assembly of claim 5, further including comprising:

a pair of rear crossbars, each rear crossbar being coupled to and extending between the legs positioned on an associated plate proximate to the rear edge of the seat;

a pair of front crossbars, each front crossbar being coupled to and extending between the legs positioned on an associated plate proximate to the front edge of the seat, one front crossbar and an associated rear crossbar extending past an associated opposing side edge of the seat; and a pair of side crossbars, each side crossbar being coupled to and extending between the legs positioned on an associated plate proximate to the respective opposing side edge of the seat wherein each side crossbar, an associated rear crossbar, and an associated front crossbar define a frame to which an associated plate is coupled.

9. The assembly of claim 5, further including a pair of crossbeams, each crossbeam being coupled to and extending between the legs positioned proximate to a respective opposing side edge of the seat, the crossbeam being positioned proximate to the seat wherein the crossbeam is positioned for stabilizing the legs relative to the seat.

10. The assembly of claim 1, further including the backrest being concavely arcuate wherein the backrest is configured for complementing a profile of the back of the bather.

11. The assembly of claim 8, further including the backrest comprising:

a pair of support rods coupled to and extending from the frame such that the support rods protrude from the rear edge of the seat;

a pair of vertical rods, each vertical rod being coupled to and extending substantially perpendicularly from a respective support rod distal from the seat; and a panel coupled to the vertical rods distal from the support rods, the panel extending arcuately between the vertical rods.

12. The assembly of claim 11, further including a handle coupled to the backrest wherein the handle is configured for grasping in a hand of a user, the handle comprising an orifice positioned through the panel, the orifice being rectangularly shaped.

13. The assembly of claim 1, further including a plurality of feet, each foot being coupled to a lower end of a respective leg, the feet comprising rubber wherein the feet are configured for gripping a surface upon which the legs are positioned.

14. The assembly of claim 1, further including a plurality of drain holes positioned through the seat wherein the drain holes are configured for draining of water through the seat.

15. The assembly of claim 1, further including an armrest coupled to and extending from a respective opposing side edge of the seat wherein the armrest is configured for supporting an arm of the bather.

16. A bathing chair assembly comprising:

a seat, the seat being substantially rectangularly shaped, the seat comprising a pair of plates, each plate extending from the rear edge to a front edge along a respective opposing side edge of the seat, the plates defining a gap positioned substantially equally distant from the opposing side edges of the seat, the void comprising the gap defined by the first plate and the second plate;

a plurality of legs coupled to and extending substantially perpendicularly from a bottom of the seat wherein the legs are configured for supporting the seat substantially parallel to a substantially horizontal surface positioning the seat for supporting a bather, the plurality of legs comprising eight legs positioned singly at each corner of each of the pair of plates;

a backrest coupled to and extending from a rear edge of the seat wherein the backrest is configured for supporting a back of the bather positioned on the seat;

a void centrally positioned in the seat wherein the void is configured for allowing a user access to genital and perianal regions of a bather positioned on the seat;

a pair of rear crossbars, each rear crossbar being coupled to and extending between the legs positioned on an associated plate proximate to the rear edge of the seat;

a pair of front crossbars, each front crossbar being coupled to and extending between the legs positioned on an associated plate proximate to the front edge of the seat, one front crossbar and an associated rear crossbar extending past an associated opposing side edge of the seat;

a pair of side crossbars, each side crossbar being coupled to and extending between the legs positioned on an associated plate proximate to the respective opposing side edge of the seat wherein each side crossbar, an associated rear crossbar, and an associated front crossbar define a frame to which an associated plate is coupled;

a pair of first rods coupled singly to and extending perpendicularly from the one front crossbar and the associated rear crossbar extending past the associated opposing side edge of the seat; and a second rod coupled to and extending between the first rods distal from the respective plate.

17. A bathing chair assembly comprising:

a seat, the seat being substantially rectangularly shaped, the seat comprising a pair of plates, each plate extending from the rear edge to a front edge along a respective opposing side edge of the seat, the plates defining a gap positioned substantially equally distant from the opposing side edges of the seat, the void comprising the gap defined by the first plate and the second plate;

a plurality of legs coupled to and extending substantially perpendicularly from a bottom of the seat wherein the legs are configured for supporting the seat substantially parallel to a substantially horizontal surface positioning the seat for supporting a bather, the plurality of legs comprising eight legs positioned singly at each corner of each of the pair of plates;

a backrest coupled to and extending from a rear edge of the seat wherein the backrest is configured for supporting a back of the bather positioned on the seat;

a void centrally positioned in the seat wherein the void is configured for allowing a user access to genital and perianal regions of a bather positioned on the seat;

a pair of rear crossbars, each rear crossbar being coupled to and extending between the legs positioned on an associated plate proximate to the rear edge of the seat;

a pair of front crossbars, each front crossbar being coupled to and extending between the legs positioned on an associated plate proximate to the front edge of the seat, one front crossbar and an associated rear crossbar extending past an associated opposing side edge of the seat;

a pair of side crossbars, each side crossbar being coupled to and extending between the legs positioned on an associated plate proximate to the respective opposing side edge of the seat wherein each side crossbar, an associated rear crossbar, and an associated front crossbar define a frame to which an associated plate is coupled;

a center crossbar coupled to and extending between the other front crossbar and an associated rear crossbar; and a pivot coupled to the center crossbar substantially equally distant from the other front crossbar and the associated rear crossbar, an associated plate being coupled to the pivot wherein the associated plate is positioned for rotating relative to an associated frame.

18. The assembly of claim 1, further including a connector coupled to a second end of the shaft, the connector being configured for removably coupling to the backrest for coupling the tool to the backrest, the connector comprising a hook extending from the second end of the shaft.

19. A bathing chair assembly comprising:

a seat, the seat being substantially rectangularly shaped, the seat comprising a pair of plates, each plate extending from a rear edge to a front edge along a respective opposing side edge of the seat, the plates defining a gap positioned substantially equally distant from the opposing side edges of the seat;

a plurality of legs coupled to and extending substantially perpendicularly from a bottom of the seat wherein the legs are configured for supporting the seat substantially parallel to a substantially horizontal surface positioning the seat for supporting a bather, the legs being circularly shaped when viewed longitudinally, each leg comprising a plurality of nested sections such that the leg is selectively extensible, the plurality of nested sections comprising an upper section selectively extensible from a lower section, the plurality of legs comprising eight legs positioned singly at each corner of each of the pair of plates;

a plurality of first couplers, each first coupler being coupled to the upper section of a respective leg proximate to a lower terminus of the upper section;

a plurality of second couplers, each second coupler being coupled to the lower section of a respective leg, the second couplers being complementary to the first couplers wherein each second coupler is positioned for selectively coupling to an associated first coupler for coupling the lower section to the upper section for fixedly positioning the lower section relative to the upper section, each second coupler comprising a plurality of leg holes, each first coupler comprising a pin, the pin being spring-loaded wherein the pin is configured for depressing for selectively extending the upper section relative to the lower section positioning the pin for inserting into a respective leg hole for fixedly positioning the upper section relative to the lower section;

a pair of rear crossbars, each rear crossbar being coupled to and extending between the legs positioned on an associated plate proximate to the rear edge of the seat;

a pair of front crossbars, each front crossbar being coupled to and extending between the legs positioned on an associated plate proximate to the front edge of the seat, one front crossbar and an associated rear crossbar extending past an associated opposing side edge of the seat;

a pair of side crossbars, each side crossbar being coupled to and extending between the legs positioned on an associated plate proximate to the respective opposing side edge of the seat wherein each side crossbar, an associated rear crossbar, and an associated front crossbar define a frame to which an associated plate is coupled;

a pair of crossbeams, each crossbeam being coupled to and extending between the legs positioned proximate to a respective opposing side edge of the seat, the crossbeam being positioned proximate to the seat wherein the crossbeam is positioned for stabilizing the legs relative to the seat;

a backrest coupled to and extending from the rear edge of the seat wherein the backrest is configured for supporting a back of the bather positioned on the seat, the backrest being concavely arcuate wherein the backrest is configured for complementing a profile of the back of the bather, the backrest comprising:

a pair of support rods coupled to and extending from the frame such that the support rods protrude from the rear edge of the seat, a pair of vertical rods, each vertical rod being coupled to and extending substantially perpendicularly from a respective support rod distal from the seat, and a panel coupled to the vertical rods distal from the support rods, the panel extending arcuately between the vertical rods;

a void centrally positioned in the seat wherein the void is configured for allowing a user access to genital and perianal regions of a bather positioned on the seat, the void comprising the gap defined by the first plate and the second plate;

a handle coupled to the backrest wherein the handle is configured for grasping in a hand of a user, the handle comprising an orifice positioned through the panel, the orifice being rectangularly shaped;

a plurality of feet, each foot being coupled to a lower end of a respective leg wherein the feet are configured for gripping a surface upon which the legs are positioned, the feet comprising rubber;

a plurality of drain holes positioned through the seat wherein the drain holes are configured for draining of water through the seat;

an armrest coupled to and extending from a respective opposing side edge of the seat wherein the armrest is configured for supporting an arm of the bather, the armrest comprising:

a pair of first rods coupled singly to and extending perpendicularly from the one front crossbar and the associated rear crossbar extending past the associated opposing side edge of the seat, and a second rod coupled to and extending between the first rods distal from the respective plate;

a center crossbar coupled to and extending between the other front crossbar and an associated rear crossbar;

a pivot coupled to the center crossbar substantially equally distant from the other front crossbar and the associated rear crossbar, an associated plate being coupled to the pivot wherein the associated plate is positioned for rotating relative to an associated frame;

a tool comprising a shaft and a head, the head being coupled to a first end of the shaft, the head comprising sponge wherein the shaft is configured for grasping in the hand of the user positioning the user for manipulating the head for cleaning the genital and perianal regions of the bather positioned on the seat; and a connector coupled to a second end of the shaft, the connector being configured for removably coupling to the backrest for coupling the tool to the backrest, the connector comprising a hook extending from the second end of the shaft.

* * * * *